United States Patent [19]

Herr

[11] Patent Number: 4,526,281

[45] Date of Patent: Jul. 2, 1985

[54] MOISTURE TIGHT CLOSURE AND CONTAINER

[75] Inventor: James E. Herr, East Petersburg, Pa.

[73] Assignee: Kerr Glass Manufacturing Corporation, Los Angeles, Calif.

[21] Appl. No.: 639,031

[22] Filed: Aug. 9, 1984

[51] Int. Cl.[3] ..... B65D 55/02

[52] U.S. Cl. ..... 215/211; 215/222; 215/224

[58] Field of Search ..... 215/211, 206, 205, 224, 215/225, 222

[56] References Cited

U.S. PATENT DOCUMENTS

| | | | |
|---|---|---|---|
| Re. 29,779 | 9/1978 | Morris . | |
| 2,447,166 | 8/1970 | Daffer . | |
| 3,630,403 | 12/1971 | Berg . | |
| 3,757,979 | 9/1973 | Berghahn | 215/224 |
| 3,811,590 | 5/1974 | Hall, Jr. . | |
| 3,863,797 | 2/1975 | Berghahn | 215/225 |
| 3,865,267 | 2/1975 | Morris . | |
| 3,926,325 | 12/1975 | Benson . | |
| 4,036,385 | 7/1977 | Morris . | |
| 4,053,078 | 10/1977 | Herr . | |
| 4,095,718 | 6/1978 | Kong . | |
| 4,103,797 | 8/1978 | Morris . | |
| 4,156,489 | 5/1979 | Kong . | |
| 4,337,869 | 7/1982 | Guinle . | |
| 4,397,397 | 8/1983 | Herr . | |
| 4,406,376 | 9/1983 | Berghahn . | |

*Primary Examiner*—George T. Hall

*Attorney, Agent, or Firm*—Fitch, Even, Tabin & Flannery

[57] ABSTRACT

A moisture proof vial and closure system are provided which may be used in a child-resistant mode or in a non-child resistant mode. In the child-resistant mode locking lugs 22 on the closure are interlocked with bayonnet slots on the vial. A non-child resistant operation in a moisture proof system may be achieved by providing an integral sealing plug 21 extending from the top of the closure and by adding a detenting means 51 inside of the container to engage and hold the sealing plug 21 against sliding outwardly of the container. A simple push inward will force the sealing plug 21 home to its sealing position to seal the medicine in the vial, and a simple push or pull on the closure to force the fitment from the detenting means is needed to remove the closure. The preferred detenting means 51, 15 is in the form of radially inwardly directed projections 52 formed on the interior container wall to abut and restrain the sealing plug against inadvertent sliding from the container. For the child-resistant mode, the sealing bead 50 on closure 10 is carried on sealing plug 39 which is formed on a discrete and separable fitment 40, while in the non-child resistant mode, the sealing plug 21 is integral with the top wall 18 of the closure.

6 Claims, 9 Drawing Figures

MOISTURE TIGHT CLOSURE AND CONTAINER

The present invention is an improvement of U.S. Pat. No. 4,397,397 issued Aug. 9, 1983 and relates to safety closures and containers and more particularly to a combination thereof which may be either child-resistant or non-child resistant.

Child-resistant safety closures and associated containers are known in which the container and closure have cooperative locking lugs, the lugs on the container or closure having recesses to effect a locking or unlocking upon downward and rotational movement of the closure. Federal law requires medicine containers to be equipped with child-resistant closures to avoid injury to curious children who seek access to the contents of the containers. As a result of the aforedescribed problem, containers have been developed where some type of complex movement or manipulation of the closure with respect to the container is mandated to limit the accessibility of the contents of the container to children.

For the packaging of medicines in vial type containers, today's standards require that the closure and vial container be "moisture tight" in the sense that less than 100 milligrams of moisture per day per liter of volume enter the seal container. Herr, U.S. Pat. No. 4,053,078 issued Oct. 11, 1977, and assigned to Kerr Glass Manufacturing Corporation, describes just such a container and closure; said patent being herein incorporated by reference.

Child resistant containers, however, may pose some problems to the elderly, or to arthritic persons. For instance, arthritics may lack the capability to remove child-resistant closures. The elderly, those with visual problems, and those having a low degree of physical dexterity often experience difficulty in removing child-resistant closures.

Accordingly, a general object of the present invention is to provide an improved moisture tight container and closure system which can be either child-resistant or non-child resistant.

Further objects and advantages of the present invention will become apparent from the following detailed description of the invention when taken in conjunction with the accompanying drawings wherein.

Figure 1:
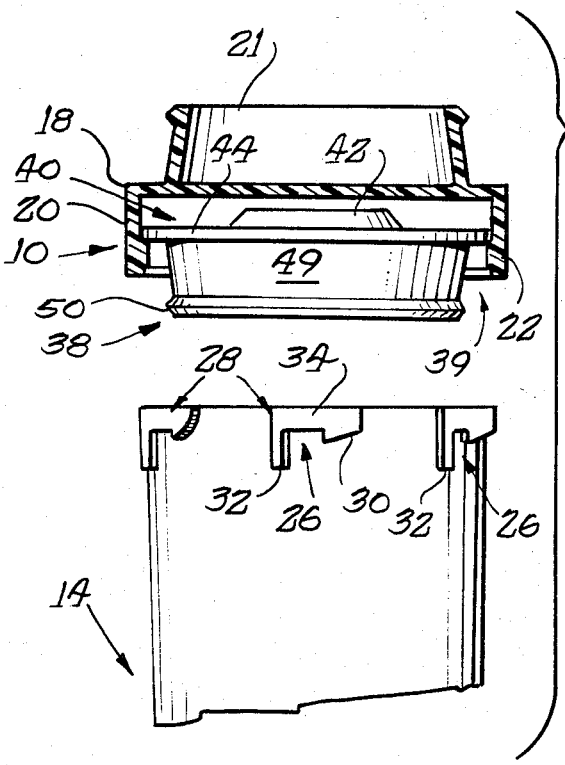
FIG. 1 is a partial elevational view, portions being shown in longitudinal section, illustrating a closure and container system wherein the closure is constructed in accordance with the preferred embodiment of the invention and disposed above the container in its child-resistant mode.

As shown in the drawings for purposes of illustration, the invention is embodied in a system having a closure indicated generally by 10, and a container 14, such as a medicine vial, having an open mouth 12 at its upper end which is to be covered by the closure. The closure includes an upper planar, circular top wall 18 and an integral skirt wall 20 depending from the top wall to surround the upper end of the container when the closure is in its child-resistant mode. The moisture tight seal is obtained by sealing plug 39 which may be constructed on a fitment 40 as disclosed fully in U.S. Pat. No. 4,053,078. The sealing plug 39 includes a central annular plug wall 48 with a sealing means 38 thereon for sealing engagement with an interior wall 58 of the container.

The illustrated sealing means 38 is in the form of a radially, outwardly-directed, annular bead 50 projecting from the small diameter plug wall 48 to abut and to be held in compression by the cylindrical container wall 58. The relaxed or free diameter of the sealing bead is larger than the diameter of the cylindrical container wall so that the sealing bead 50 is compressed by the wall when engaged thereby.

In the system disclosed in U.S. Pat. No. 4,053,078, the fitment sealing bead compression was insufficient to hold the fitment and closure onto the vial, and it was necessary to turn and compress the fitment's upper crown portion 42 and web 46 to insert locking lugs 22 on the closure into the retaining recesses 26 on the outer side wall of the container. With the locking lugs 22 thus entered into the recesses 26, the closure and container were interlocked in the child-resistant mode. To turn the locking lugs 22 from alignment with the recesses so that the locking lugs could be passed upwardly in the space between recesses, both a downward force to compress the fitment spring and a simultaneous rotation of the closure are required. It is the combination of such movements that makes the system child-resistant, but also makes it difficult for some elderly or arthritic people to open and, consequently, such persons prefer non-child resistant closure systems.

Figure 7:
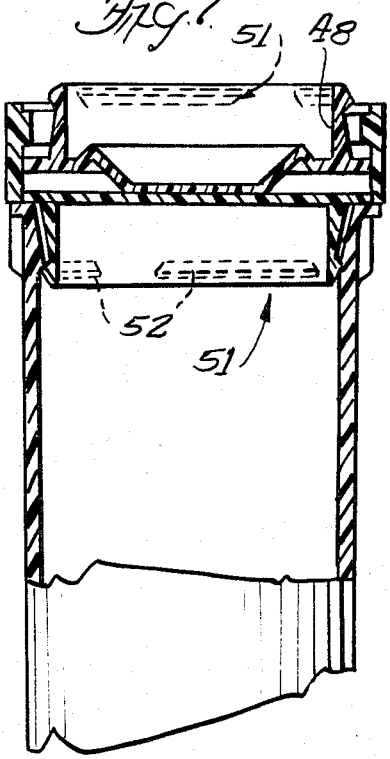
FIG. 7 is a cross-sectional view of the closure and container with the closure being secured on the container in its non-child resistant mode.

In accordance with the present invention, non-child resistant operation of a moisture proof system may be achieved by providing an integral sealing plug 21 extending from the top wall of the closure 10 on the opposite side from fitment 40 and by adding a detenting means 51 inside of the container to engage and hold the sealing plug 21 against sliding outwardly of the container. As best seen in FIG. 7, a simple push inward will force the sealing plug 21 home to its sealing position to seal the medicine in the vial, and a simple push or pull on the closure to force the fitment from the detenting means is needed to remove the closure. The preferred detenting means 51 is in the form of radially inwardly directed projections 52 formed on the interior container wall to abut and restrain the sealing plug against inadvertent sliding from the container. Often, women carry pill vials in their purses, and the motion of the pills in the vial would push the sealing plug from the vial, unless the closure is positively restrained.

The child-resistant portion of the closure 10 as illustrated herein is identical to the closure disclosed in U.S. Pat. No. 4,053,078. The sealing bead 50 on the child-resistant portion of closure 10 is carried on sealing plug 39 which is formed on a discrete and separable fitment 40. This is in contrast to the non-child resistant portion of the closure 10 in which the sealing plug 21 is integral with the top wall 18 of the closure. Also, in the child-resistant mode, the locking lugs 22 on the skirt 20 of the closure will interlock with locking member recesses 26 on the container to secure the closure to the container.

It is preferred that the portion of the sealing plugs 39, 21 being detented is the sealing bead 50, 50*a*, respectively. When the sealing beads 50, 50*a* go across and expand below the detent projections 52, a definite snap action is felt, thereby assuring the user that the closure is in a secured position. Preferably, the detent projections 42 are spaced in a circumferential direction from each other by spaces 61, into which the bead material may expand during the maximum compression of the sealing bead by the projections. These spaces aid in reducing the amount of force needed to push the bead down past the projections or to pull the bead up past the projections.

The preferred detent projections 52 are located adjacent the bottom portions of the locking members 28 on the container so that the sealing engagement with the cylindrical container wall is at a location below the bottom of a tapered-in surface 54 on the container's internal wall 58 and which indicates the bottom of the molded portions forming the locking lug recesses 26 in the container.

To assist in sliding the sealing bead 50 past the detent projections 52, they are preferably provided with upper and lower inclined camming surfaces 57 and 59. The upper camming surface 57 is inclined inwardly and downwardly to gradually cam the compressed sealing bead 50 to a smaller size until it passes the inner rim surface 62 on the detenting projections. For a similar reason, the camming surface 59 is directed radially inwardly and upwardly from its lower edge at the container wall 58 to its juncture with the inner rim surface 62 on the projections.

Referring now in greater detail to the closure 10, a plurality of locking members in the form of locking lugs 22, of which there are six in the illustrated embodiment, are formed on and project radially inwardly from the inner surface of the skirt wall 20 in circumferentially equidistantly spaced relation thereabout. The locking lugs 22 are spaced below the upper cap wall 18 and are cooperable with complementary locking members in the form of recesses or grooves 26 defined by projections 28 formed on the upper open end 12 of container 14 so as to releasably mount the closure 10 onto the container. The illustrated closure 10 has six lugs to hold the closure in a locked position.

With particular reference to FIG. 1, each of the retaining recesses 26 on the container 14 opens downwardly toward the bottom of the container. In mounting the closure 10 on the container 15, it is brought to a position wherein the locking lugs 22 can move downwardly onto the container 15 between the projections 28. When the closure 10 is moved downwardly over the container and simultaneously rotated, the locking lugs 22 slide along the cam wall 30 into recesses 26. In the embodiment shown, the recesses are defined by the projections on the container. This may be reversed, however, with locking lugs formed on the container and the recesses formed in the skirt wall 20 of the closure 10.

To provide a moisture tight seal between the closure 10 and the container 14 that substantially excludes the intrusion of moisture vapor to levels equal to or less than U.S. government standards, both sealing plugs 39, 21 of the closure 10 are formed with sealing means, indicated generally at 38, 38*a*, respectively, adapted for engagement with the internal wall of the container at a distance axially downward from the open mouth end 12 to just below the detent projections 52 as will be discussed in more detail below. (The corresponding elements on the sealing plug 21 are designated by the same number as used for the sealing plug 39, except that the reference numerals for the former are followed by an a. See FIG. 8. Consequently, only the elements of the sealing plug 39 will be described in detail.) The sealing means 38 for the closure 10 is on the separate fitment 40. Preferably, the fitment 40 is made of polyethylene, or other suitable plastic, which has good moisture barrier properties and flexibility, and is formed as a unitary member by conventional molding or other suitable manufacturing techniques.

The fitment 40 includes a generally planar circular crown portion 42 which is formed integral with an annular flange 44 through an interconnecting annular transverse V-shaped web 46 such that the plane of the crown 42 is disposed a predetermined distance above the plane of the annular flange 44. The fitment 40 includes a downwardly depending annular wall 48 formed integrally at its upper end with a lower surface of the annular flange 44 adjacent the V-shaped web 46. The annular wall 48 has a fustoconical outer peripheral surface 49 which terminates at its lower ledge in the radially outwardly directed circumferential sealing bead 50 formed adjacent a lower annular edge surface 52 of the wall 48.

Figure 2:
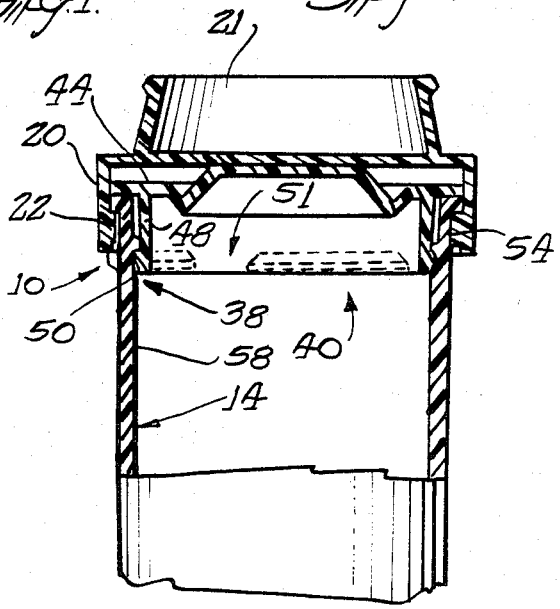
FIG. 2 is a partial elevational view, portions being shown in longitudinal section illustrating the closure and container system of FIG. 1.
Figure 3:
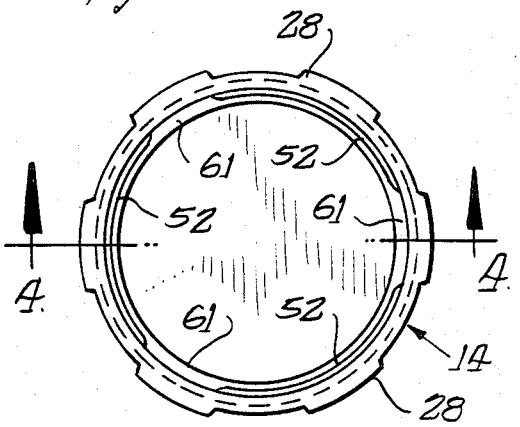
FIG. 3 is a plan view of the container.
Figure 4:
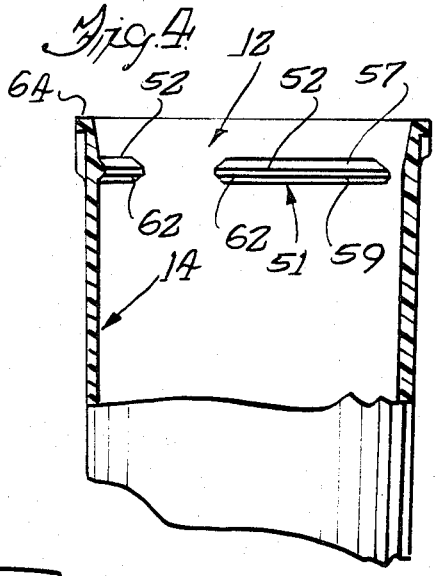
FIG. 4 is a partial sectional view of the container taken along the line 4—4 of FIG. 3.
Figure 5:
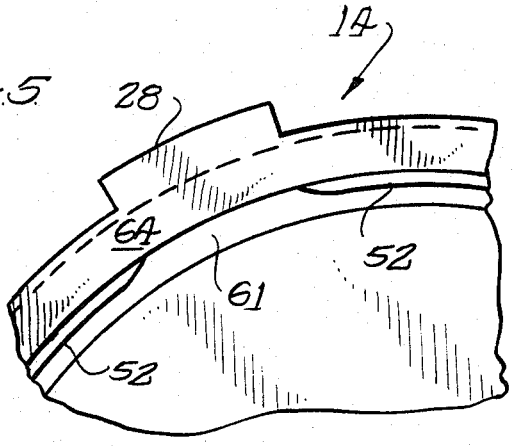
FIG. 5 is an enlarged fragmentary plan view of a portion of the container.
Figure 6:
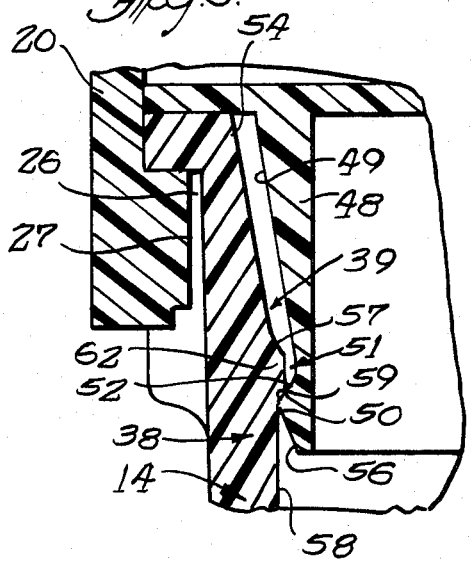
FIG. 6 is a fragmentary enlarged cross-sectional view of the closure and container of FIG. 2.
Figure 8:
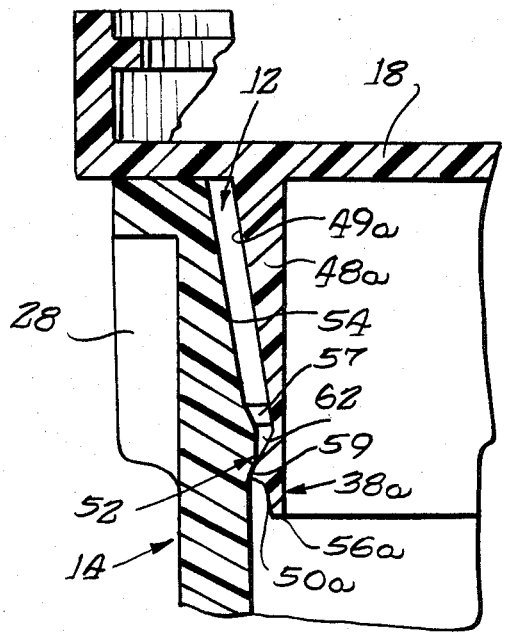
FIG. 8 is a fragmentary enlarged cross-sectional view of the closure and container as shown in FIG. 7.

The fitment 40 is formed so that the annular flange 44 has an outer diameter greater than the diameter of the innermost surfaces of the radially inwardly projecting locking lugs 22 on the closure 10 so that the fitment may be inserted within the closure 10 and retained within the skirt 20 by the lugs 22 as shown in FIG. 2. As seen in FIG. 1, the fitment crown 42 is spaced above the plane of the annular flange 44 a distance less than the axial spacing between the lugs 22 and the upper wall 18 of the closure. Thus, the crown 42 of the fitment is formed to lie above the plane of the flange 44 by a distance sufficient to effect compression of the crown 42 against the upper wall 18 of the closure 10 when the closure is mounted on the container with the locking lugs 22 of the closure 10 disposed within the retaining notches 26 of the container 14. The compression force exerted by the crown of the fitment against the upper wall of the closure biases the locking lugs 22 upwardly against the upper bridges 34 which define the upper edges of the retaining notches 26. With the closure 10 thus applied, the bead 50 will be below the detent projections 52. In contrast, in the non-child resistant mode of the closure 10, when the bead 50*a* on the closure 10 is shoved downwardly past the detent projections 52 and is released there is no spring force from any fitment trying to urge the sealing bead 50*a* upwardly past the detent projections 52. The distance from the underside (as seen in FIG. 8) of the cap top wall 18 to the upper edge of the sealing bead 50*a* is chosen to keep the closure 10 on tight without rattling and with the rim of the container abutting the underside of the cap top wall 18. Thus, the closure 10 is held onto the container by the sealing bead 50*a* engaging the lower camming surface of the detent projections 52.

The lead-in surface 54 of the container 14 is particularly useful in applying the closure 10 to the container in that the sealing bead 50 has a smaller diameter than the diameter of lead-in surface 54 at diameter top end of the lead-in surface, and hence, the bead need not be precisely centered to fit therein. Thus, the sealing bead 50 will be centered automatically by the tapered lead-in surface as the bead 50 moves downwardly therealong. A lower edge 56 on the bead 50 which is inclined radially inwardly below the bead facilitates the camming and centering of the sealing plug into a properly centered position to slide down the lead-in surface. This facilitates applying the closures to the containers with automated equipment.

The thickened cross-section for the bead 50 assures that the bead is relatively stiff, thus assuring that the bead will maintain its sealing contact with the container wall and will not be deformed into an oval or other configuration which would allow gases and moisture to enter. Also, the thickened cross-section with the tapered surface 56 prevents wear or damage to this lower sealing end of the sealing plug whereas, in contrast, a very thin sealing end may be damaged by abutting the container rim and the detent projections 52 after reusage and, thus, lose its sealing capability.

As stated in U.S. Pat. No. 4,053,078, the sealing bead 50 is adapted to engage the interior surface of the container at a location axially below any out-of-round surface within the neck of the container. In accordance with the illustrated embodiment, the sealing bead 50 is formed to engage the internal surface of the container neck generally adjacent, and axially below the lower ends of the long stop wall portions 32 of the radial projections 28, and below the detent projections 52.

As previously noted, the lower ends of the projections 52 terminate at substantially the same axial location as the lower edge of the lead-in surface 54. The sealing bead 50 is sized to have a slightly larger diameter than the internal cylindrical diameter of the container's cylindrical wall 58 so that the sealing edge is compressed radially inwardly by the wall 58 at a location below the lead-in surface and below the locking projections 52.

Figure 9:
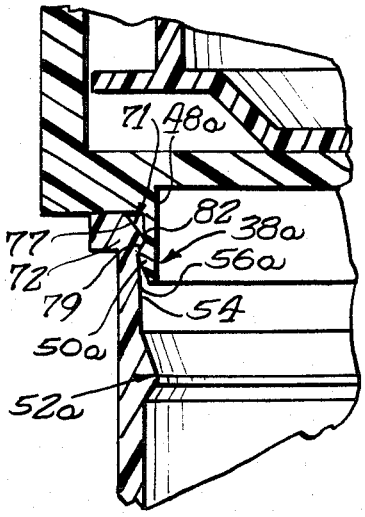
FIG. 9 is a fragmentary enlarged cross-sectional view of an alternative embodiment of the non-child resistant portion of the closure and container.

Referring to FIG. 9, an alternative embodiment of the inventive closure and container is shown. In order to reduce the amount of plastic required to manufacture the closure, the height of the non-child resistant portion of the closure has been reduced. As a result, the detenting means 51 no longer can engage both the sealing beads 38 and 38*a*. Consequently, a second detenting means 71 is provided on the lead in surface 54 adjacent the upper end of the mouth 12 of the container. The detent projections 72 are provided with upper and lower camming surfaces 57 and 59 that assist in sliding the sealing bead 50*a* past the projections. As with camming surfaces 57 and 59, the upper camming surface 77 is inclined inwardly and downwardly to gradually cam the compressed sealing bead 50*a* to a smaller size until it passes the inner rim surface 82 on the detenting projections 72, while camming surface 79 is directed radially inwardly and upwardly from its lower edge. In practice, the inside diameter of the detent projections 72 is greater than the outside diameter of the sealing bead on the fitment 40 so that there is no interference therebetween when the closure is used in its child-resistant mode. In all other respects, the shape and operation of the embodiment of FIG. 9 is substantially identical to the embodiment of FIGS. 1–8.

In manufacturing plastic and glass containers having configurations as described in respect to the container 14, that is, having locking recess projections 28 formed circumferentially thereabout adjacent the upper open ends thereof, and particularly when manufacturing such containers on a mass production basis, the upper annular surface, as indicated at 64 on the container 14, may not be planar within close dimensional tolerances. As a result, when a closure 10 having a fitment 40 is mounted on the container with the annular flange 44 of the fitment engaging the upper edge 64 of the container, a moisture tight seal between the fitment flange 44 and the upper edge of the container is not accomplished.

It is also a common practice in manufacturing containers such as the container 14 by molding to provide one more more vent grooves in the upper annular edge 64 to allow escape of gas during molding. The vent grooves prevent full circumferential sealing contact between the fitment flange and the upper edge of the container neck. While the upper edge of the container neck could be machined to eliminate the grooves, the added machining adds to the manufacturing costs. In the closure 10, the surface of the closure top wall 18 abuts the container's annular edge but does not seal against the same because of the vent grooves in the top edge 64.

The preferred closure 10 is molded from a polyolefin plastic material such as polypropylene or polyethylene plastic which allows it to be used as a "snap cap". More specifically, in its non-child resistant mode, the closure 10 acts as a "snap cap" in that the thumb may be used to lift the side of the cap to force it from the container.

From the foregoing it will be seen that both modes of the closure 10 have the annular sealing bead 50, 50*a* forming a moisture tight seal with the container internally of the open mouth thereof below any lead-in surface thereon. The need for a true planar upper edge 64 on the container is eliminated. In the non-child resistant mode of the closure 10, the sealing bead 50*a* abuts the undersides of the detent projections 52 and is thus held onto the container. For the child-resistant mode of the closure 10, the locking lugs 22 on the closure are interlocked with the locking member recesses 26 to hold the closure 10 in a child-resistant system.

Thus, in accordance with the present invention, a container is provided which is suited to receive a closure 10 is a child-resistant or non-child resistant mode. The closure, when associated with the container, gives a moisture tight seal with the container in which the oontainer can be readily opened and resealed with the closure. The invention further permits a druggist to carry a single inventory of containers and closures 10. Depending on the preference of the consumer, the druggist will select the appropriate mode of the closure 10 for use with the container 14 which accommodates either closure.

While preferred embodiments of the present invention have been illustrated and described, it will be obvious to those skilled in the art that changes and modifications may be made therein without departing from the invention in its broader aspects. Various features of the invention are set forth in the following claims.

What is claimed is:

1. A closure and container having a moisture tight sealing engagement with each other, said closure having both a child-resistant and non-child resistant portion, comprising:

a container having a side wall, an upper end with an open mouth over which said closure is received, and locking members on said container adjacent said upper end;

an interior wall on said side wall of said container having detent projections extending inwardly into the hollow interior of the container, the ends of the detent projections being spaced from one another in a circumferential direction to define spaces between adjacent projections;

a closure having a top wall adapted to extend across the mouth of said container having a first sealing plug depending therefrom, said first sealing plug being within a skirt wall depending from said top wall and having a depending wall for insertion into said open mouth of said container, said skirt wall having locking members thereon to interlock with the locking members on the container to secure said closure to said container in a child-resistant manner;

a second sealing plug integral with said top wall and having a depending wall for insertion into said open mouth of said container, said second sealing plug extending from said top wall on the side opposite said first sealing plug to secure said closure to said container in a non-child resistant manner; and said depending walls of said first and second sealing plugs each having an outwardly projecting annular sealing surface, said annular sealing surface having a diameter substantially larger than an inner diameter defined by said detent projections, portions of said annular sealing surface expanding into the spaces between adjacent detent projections as the sealing surface is being pushed down past the projections or is being pulled upwardly past the projections, said sealing surface extending below said container mouth to engage said interior wall below said projections so as to provide a moisture tight sealing engagement of said closure with said container, said projections holding the closure on said container.

2. A closure and container in accordance with claim 1 in which the detent projections are located adjacent the lower ends of locking members on the container so that the sealing engagement is located below the lower ends of the locking members.

3. A closure and container in accordance with claim 1 in which said first sealing plug and said top wall are separately formed members.

4. A closure and container having a moisture tight sealing engagement with each other, said closure having both a child-resistant and non-child resistant portion, comprising:

a container having a side wall, an upper end with an open mouth over which said closure is received, and locking members on said container adjacent said upper end;

an interior wall on said side wall of said container having a series of first detent projections and a series of second detent projections positioned above said first series of projections adjacent to said container mouth, both of said series of projections extending inwardly into the hollow interior of the container, the ends of the detent projections in each series being spaced from one another in a circumferential direction to define spaces between adjacent projections;

a closure having a top wall adapted to extend across the mouth of said container having a first sealing plug depending therefrom, said first sealing plug being within a skirt wall depending from said top wall and having a depending wall for insertion into said open mouth of said container, said skirt wall having locking members thereon to interlock with the locking members on the container to secure said closure to said container in a child-resistant manner;

a second sealing plug integral with said top wall and having a depending wall for insertion into said open mouth of said container, said second sealing plug extending from said top wall on the side opposite said first sealing plug to secure said closure to said container in a non-child resistant manner; and said depending walls of said first and second sealing plugs each having an outwardly projecting annular sealing surface, the sealing surface on said first sealing plug being adapted to engage said first series of detent projections with the sealing surface on said second sealing plug being adapted to engage said second series of detent projections, said annular sealing surfaces having a diameter substantially larger than an inner diameter defined by said detent projections, portions of said annular sealing surfaces expanding into the spaces between adjacent detent projections as the sealing surface is being pushed down past the projections or is being pulled upwardly past the projections, said sealing surface extending below said container mouth to engage said interior wall below said projections so as to provide a moisture tight sealing engagement of said closure with said container, said projections holding the closure on said container.

5. A closure and container in accordance with claim 4 in which the first series of detent projections is located adjacent the lower ends of locking members on the container so that the sealing engagement of the first sealing plug is located below the lower ends of the locking members.

6. A closure and container in accordance with claim 4 in which said first sealing plug and said top wall are separately formed members.

* * * * *